US008752567B2

(12) United States Patent
Brazeau

(10) Patent No.: US 8,752,567 B2
(45) Date of Patent: Jun. 17, 2014

(54) RUPTURE PROTECTION DEVICE FOR A FROST-FREE HYDRANT

(76) Inventor: Wayne Brazeau, Timmins (CA)

( * ) Notice: Subject to any disclaimer, the term of this patent is extended or adjusted under 35 U.S.C. 154(b) by 228 days.

(21) Appl. No.: 12/973,629

(22) Filed: Dec. 20, 2010

(65) Prior Publication Data

US 2012/0152371 A1 Jun. 21, 2012

(51) Int. Cl.

| | |
|---|---|
| ***F16L 5/00*** | (2006.01) |
| ***F16L 7/00*** | (2006.01) |
| ***E03B 9/02*** | (2006.01) |

(52) U.S. Cl.

CPC ..... *E03B 9/027* (2013.01)

USPC ..... 137/15.02; 137/360; 137/375

(58) Field of Classification Search

USPC ..... 137/360, 283, 301, 312, 15.02, 375

See application file for complete search history.

(56) References Cited

U.S. PATENT DOCUMENTS

| | | | | |
|---|---|---|---|---|
| 4,473,244 | A * | 9/1984 | Hill | 285/14 |
| 5,603,347 | A * | 2/1997 | Eaton | 137/360 |
| 6,668,852 | B1 * | 12/2003 | Williamson | 137/312 |

* cited by examiner

*Primary Examiner* — John Rivell
*Assistant Examiner* — Kevin E Lynn
(74) *Attorney, Agent, or Firm* — Stuart L. Wilkinson

(57) ABSTRACT

A fitment for providing leak protection at a frost-free hydrant has a protective sheath having a bore of a first diameter. An escutcheon plate is formed at an outer end of the sheath to define an aperture for receiving a frost-free hydrant into the sheath. The sheath is made longer than any of a range of frost-free hydrants to be received therein and has an end cap sealingly connected to an inner end of the sheath. The end cap has a reducing section and an end section having a bore of a second diameter smaller than the first diameter, and dimensioned to receive a link pipe in a sealing connection, the link pipe being of a length to bridge the distance between an inner end of the hydrant and building water supply equipment. In use, the hydrant with link pipe attached is inserted into the protective sheath and the combination of the hydrant and sheath is fully into the wall through a hole in the wall. The link pipe is then sealingly connected at the second diameter bore and to the building water supply equipment.

2 Claims, 2 Drawing Sheets

RUPTURE PROTECTION DEVICE FOR A FROST-FREE HYDRANT

FIELD OF THE INVENTION

This invention relates to a plumbing fitment for use with a frost-free hydrant to provide protection against water damage in the event of a rupture in the frost-free hydrant.

DESCRIPTION OF RELATED ART

Frost-free hydrants are devices which connect outside plumbing, for example, a garden faucet to inside plumbing, which typically includes a supply pipe and an internal shut-off valve. The frost-free hydrant is particular adapted for cold weather environments when the temperature outside a residential or commercial building may be below freezing point and the temperature within the building is high enough for comfortable interior living. The frost-free hydrant is mounted so as to extend through a wall of the building and, for this reason, frost-free hydrants are available in a range of lengths, usually at 2 inch increments, the range typically extending from 8 inches to 14 inches so as to accommodate both thin and thick walls. The frost-free hydrant is basically a pipe for supplying water from a supply pipe inside the house to a faucet or like device on the outside of the house. An important feature of the frost-free hydrant is a valve having a long valve stem that is located internally of the pipe for supplying water. The valve stem has an externally threaded portion received in an internally threaded bore formed in the pipe so that when the valve stem is turned in a clockwise manner by means of a handle at the outer end of the frost-free hydrant, the other end of the stem drives a washer against a seat in at the inner end of hydrant cut off water supply from the supply pipe into the frost-free hydrant. If the handle is turned in an anticlockwise manner, the valve is opened to restore the supply of water to the hydrant.

In normal operation, the valve is deliberately closed when the outside temperature is expected to fall below freezing point in order to reduce the risk of frost damage. Any water contained in the frost-free hydrant upon valve closure flows along the pipe and out of the garden faucet. The faucet will track the outer air temperature whereas any water behind the valve seat, because is situated well into the building, is substantially at the air temperature inside the building and so is unlikely to freeze even if the outside temperature is very low.

A problem with conventional frost-free hydrants arises if a hose remains screwed onto the faucet when really cold temperatures start to occur. In these circumstances, water in the hose and in the main chamber of the frost-free hydrant may freeze. The ice expands as the temperature falls to −4 degrees Celsius whereupon the pipe of the frost-free unit may rupture. This may not be noticed until the water in the pipe and the frost-free hydrant melts. If the water from the rupture flows back into the building, it may cause significant damage to the building interior.

This problem has been recognized by others as illustrated by prior patents related to protection devices designed to contain any water that leaks from a rupture in a frost-free hydrant and to channel it through an escape channel to the outside of the building. Consequently, when the water supply is turned on, the presence of such a rupture is evident upon detection of a flow of water from the escape channel. The frost-free unit can then be replaced without any water damage having occurred in the building interior. Examples of such protection devices are described in U.S. Pat. No. 6,668,852 (Williamson), U.S. Pat. No. 6,394,125 (White), U.S. Pat. No. 5,603,347 (Eaton), U.S. Pat. No. 4,158,366 (Van Meter).

In the following description of prior art and the description of embodiments of the invention, the use of the terms "inner and outer" is to distinguish between opposite end parts of elongate structures. The term "inner" as applied to an end part of a structure signifies that the end part of the structure is located towards the interior of the building within which the structure is mounted, while the term "outer" as applied to the end part of a structure signifies that the end part is located relatively towards the exterior of the building. In the following description also, the term "sealing connection" and variations thereof encompass soldering, brazing, welding, sweating and gluing.

U.S. Pat. No. 4,158,366 (Van Meter) describes a combination of a frost-free hydrant with a sheath matched to the length of the hydrant. The hydrant includes an inner tubular pipe forming a water-flow passage and an outer tubular pipe cooperating with the inner tubular pipe to form a water relief chamber. When the inner tubular pipe is ruptured as a result of the expansion of ice in the water-flow passage, water from the source is directed across an open valve of the hydrant into the water-flow passage where it escapes into the water relief chamber through the ruptured opening.

The relief chamber is opened to the atmosphere and water emerging therefrom alerts a person to the fact that the inner tubular pipe has ruptured thereby requiring repair or replacement.

U.S. Pat. No. 6,394,125 (White) describes a combination of a sheath and a frost-free hydrant. The sheath telescopes over the hydrant inlet end so that an outer end of the sheath mates against a bracket on the outer end of the frost-free hydrant. The outer end is vented for venting leakwater outdoors if the hydrant bursts. The length of the sheath is made such that an internally threaded bore formed near its inner end can couple to an externally threaded section of the frost-free hydrant at its inner end. At the sheath inner end, the sheath has a reduced down bell end which defines a bore enabling a solder connection with indoor piping.

U.S. Pat. No. 5,603,347 (Eaton) describes a combination of a frost-free hydrant with a sheath matched to the length of the hydrant. The device includes a tubular connector for connecting the hydrant to a supply pipe, the connector having an internally threaded bore to receive an externally threaded inner end section of the frost-free hydrant. The sheath has a diameter to contain the frost-free hydrant and is sealingly secured to the connector at its inner end. The sheath extends to an escutcheon plate at its outer end which mates with an escutcheon plate of the frost-free hydrant to leave an outlet for escaping leakwater.

U.S. Pat. No. 6,668,852 (Williamson) describes a combination of a frost-free hydrant, a protective sheath, and a telescopic hollow stem arrangement. One end of a first stem part fits against an inner end of the frost-free hydrant and the other end of the first stem part is telescopically received at one end of the other stem part. The other end of the second stem part is adapted for connection to and water supply plumbing in the building. In this way, the telescopic hollow stem arrangement provides an adjustable length link between the hydrant and the supply plumbing. The arrangement uses O-rings to seal between the outside of the stem arrangement and the interior surface of the sheath to prevent water that has escaped from a ruptured hydrant from flowing back into the building. The part of the telescopic stem part which abuts the supply plumbing is held against longitudinal shifting by a friction fit between radially adjacent components.

Each of these protection devices uses a sheath having a diameter to enclose a frost-free hydrant, the sheath forming a relief chamber in the event of a rupture of the frost-free hydrant. In each case, water escaping from the hydrant is directed by the sheath to an outlet channel on the outside of the building. In all of the structures described in these patents, the frost-free hydrant and the shaft are coupled together at a screw coupling and the sheath and hydrant have to be carefully matched in length to allow them to be assembled together. This requires tight tolerances or a risk that the sheath and hydrant may not be sufficiently accurately matched in length, regardless of supplier, as to get an effective joint at the screw coupling. In addition, different protection devices are required depending on the thickness of the wall. In the case of Williamson, the length of the hydrant is matched by virtue of a relatively complex telescopic stem having O-rings and friction fitting. This is an unsatisfactory arrangement given that the telescopic stem will tend to extend when the unit is under pressure leading, in turn, to the friction fitting being put under strain. None of the protection devices particularly lends itself to an effective retrofit process.

SUMMARY OF THE INVENTION

According to one aspect of the invention, there is provided a leak protection, frost-free hydrant assembly installed at a building comprising a frost-free hydrant having a housing, a first passage through the housing, and a valve having a long stem mounted in the first passage, the valve having a handle at one end of the frost-free hydrant and the first passage having a valve seat near the other end of the frost-free hydrant, the valve rotatable within the first passage by turning the handle to move the valve by screw action longitudinally along the first passage between closed and open positions at the valve seat, the first passage having a first bore behind the valve seat at the other end of the frost-free hydrant, the first bore dimensioned to receive pipe of predetermined exterior diameter in a sealing connection, a unitary protection device comprising a sheath having a second passage extending from one end to the other end, an escutcheon plate at said one end having an opening communicating with the second passage, an end cap at the other end having an integral tube projecting therefrom, the tube having a second bore communicating with the second passage and being dimensioned to receive pipe of the predetermined exterior diameter, the frost-free hydrant having a length which is one of a range of lengths of frost-free hydrants for use with the protection device, the length of the protection device being more than each of the lengths of said range of lengths, a link pipe of said predetermined exterior diameter sealingly connected at one end in the first bore, sealingly connected in the tube, and sealingly connected at its other end to a water supply fitment, the link pipe having a length such that the length of the combined frost-free hydrant and link pipe is greater than the length of the protection device, the protection device and the frost-free hydrant commonly fixed at their outer ends to an outside face of an exterior wall of the building.

According to another aspect of the invention, there is provided a method of installing a leak protection, frost-free hydrant assembly at an exterior wall of a building, the assembly comprising: a frost-free hydrant having a housing, a first passage through the housing, and a valve having a long stem mounted in the first passage, the valve having a handle at one end of the frost-free hydrant and the first passage having a valve seat near the other end of the frost-free hydrant, the valve rotatable within the first passage by turning the handle to move the valve by screw action longitudinally along the first passage between closed and open positions at the valve seat, the first passage having a first bore behind the valve seat at the other end of the frost-free hydrant, the first bore dimensioned to receive pipe of predetermined exterior diameter in a sealing connection, a unitary protection device comprising a sheath having a second passage extending from one end to the other end, an escutcheon plate at said one end having an opening communicating with the second passage, an end cap at the other end having an integral tube projecting therefrom, the tube having a second bore communicating with the second passage and being dimensioned to receive pipe of the predetermined exterior diameter, the frost-free hydrant having a length which is one of a range of lengths of frost-free hydrants for use with the protection device, the length of the protection device being more than each of the lengths of said range of lengths, the method comprising cutting a link pipe from pipe of said predetermined exterior diameter to a length such that the length of the combined frost-free hydrant with the link pipe sealingly connected in the first bore would be greater than the length of the protection device, sealingly connecting the link pipe in the first bore, inserting the protection device into the wall from the outside of the building so that the other end projects beyond the interior of the wall into the interior of the building, at the escutcheon plate, fixing the protection device to the wall, inserting the combined frost-free hydrant and link pipe into the second passage so that part of the link pipe is in the tube and an end part of the link pipe projects beyond the end of the tube, at the exterior of the building, connecting an outer end of the frost-free hydrant housing to the wall, in the interior of the building, sealingly connecting the link pipe in the tube, and sealingly connecting the projecting end part of the link pipe to a water supply fitment in the interior of the building.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
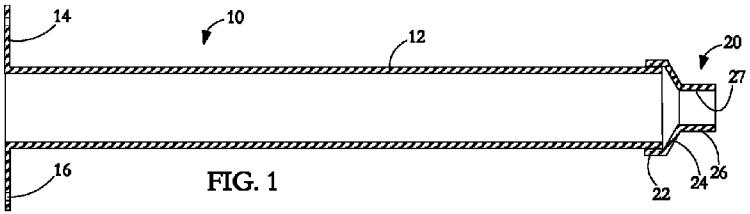
FIG. 1 shows a longitudinal sectional view of a rupture protection device for a frost-free hydrant according to one embodiment of the invention.
Figure 3:
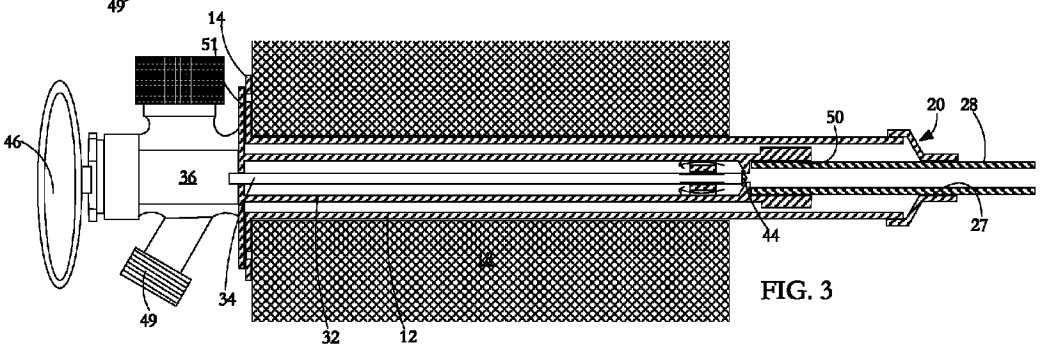
FIG. 3 shows the rupture protection device of FIG. 1 fitted to the frost-free hydrant of FIG. 2, the combination of protection device and hydrant shown mounted in a building wall.
Figure 4:
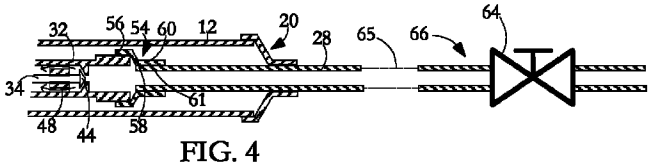
FIG. 4 shows a detail of an alternative form of rupture protection device according to an embodiment of the invention.

Referring in detail to FIG. 1, there is shown a rupture protection device 10 for a frost-free hydrant. The device has a sheath constructed of copper pipe having a nominal internal diameter of 1 inch and a length of 16.5 inches. An outer end of the sheath has an escutcheon plate 14 with apertures 16 to receive screws (not shown) for screwing the device to a building wall 18 as shown in FIG. 3. Clearly, fixture means other than screws and holes can be used for installation. At an inner end of the sheath, an end cap 20 has a wide bore section 22 that fits over the end of the sheath and is soldered to it. The cap also includes a reducing section 24 and an end section 26 which has an internal bore 27 dimensioned to receive and be soldered to a copper link pipe 28 shown in FIG. 3, the link pipe having a nominal internal diameter of half an inch.

Figure 2:
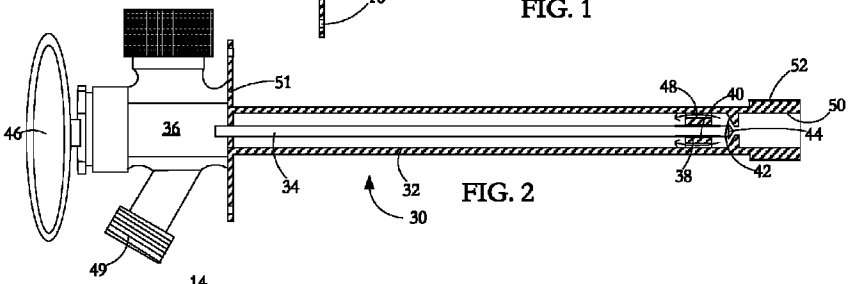
FIG. 2 shows a longitudinal sectional view of a frost-free hydrant of a form to be protected by the rupture protection device of FIG. 1.

Referring to FIG. 2, a frost-free hydrant 30 is illustrated which is of a conventional form, having a valve mechanism within a pipe 32. In use and as shown in FIG. 3, part of the valve is positioned inside the building wall 18 and a part of the valve mechanism is positioned outside the wall. A valve stem 34 is sealingly mounted at an outside bonnet part 36 and extends to an externally threaded section 38 which screw engages a corresponding internally threaded region 40 formed on the interior of the pipe 32. Longitudinally adjacent the internally threaded pipe region is a valve seat 42. In operation, the valve seat 42 is abutted by a sealing member 44 mounted on the inner end of the valve stem 34 to enable water shutoff when a handle 46 mounted to the outer end of the valve stem 34 is turned in a clockwise direction. When the handle 46 is turned anticlockwise, the valve stem 34 is withdrawn to unseat the valve and allow water to flow around threaded section 38 and through passageways 48 to a garden faucet 49. Frost-free hydrant mechanisms of different design are well known and the particular design and operation of such frost-free hydrant mechanisms are not important to the structure and operation of the invention provided that they are characterized by a valve operating mechanism that is operated from the outside of the wall and a valve shut off mechanism that is located on the inside of the wall. For example, whereas in the illustrated embodiment, the valve stem is advanced and withdrawn by cooperating threaded portions of the pipe 32 and the stem 34, in other forms of such hydrant, cooperating threaded portions are formed in the bonnet part 36. It will be understood that such frost-free mechanisms are known by various names in different parts of the world including frost-resistant hydrants, sillcocks, etc., and the invention is intended for application to all such mechanisms whatever names they go by. At the inner end of the frost-free hydrant, a bore 50 is provided to receive the end of a link pipe 28 in a soldered relationship. Typically, frost-free hydrants come in different lengths such as 8, 10, 12 and 14 inches. The bonnet part 36 has an integral escutcheon plate 51 which is formed with screw apertures, the relative screw aperture positions of the plates 14 and 51 being such that the plates can be screwed together in overlapping relationship against the wall 18 of a building within which the sheath and frost-free hydrant are to be installed.

In retrofitting a protective rupture device according to this embodiment of the invention, a measurement is made of the difference in length between the frost-free hydrant 30 and the rupture protection device 10, the lengths measured from the respective escutcheon plates. A link pipe 28 which exceeds the difference in length by a few inches is cut and soldered into the bore 50. If it is not convenient to solder at the bore 50, many frost-free hydrants have an external threaded section 52 at the inner end and in such instance, an adaptor 54 may be used instead of using the bore 50. The adaptor has an internally threaded end 56 with an external hexagonal drive enabling the adaptor to be screwed onto the externally threaded section 52. A reducing intermediate part 58 of the adaptor extends to a stub tube 60 having an internal bore 61 dimensioned to closely receive the link pipe 28 for soldering.

The frost-free hydrant with the fixed link pipe 28 soldered in place is then inserted into the rupture protection sheath 10 so that the escutcheon plates overlap. The combination of these units is then inserted through an appropriately sized hole in the building wall until the overlapping escutcheon plates 14 and 51 bear against the wall outer surface with respective screw apertures in the plates aligned to allow them to be fixed together when fixed to the wall. If the prior installation has been of a frost-free hydrant without a protective sheath, the passage through the wall may need to be enlarged to accommodate the combination of the frost-free unit with the protective sheath unit.

As is well known, the frost-free hydrant is normally turned off by closing the valve when freezing temperatures become a risk. At this time, any water that is left in the frost-free hydrant pipe will normally drain away. However, this may not be the cases if a hose has been left attached at the garden faucet. In such an event, it may be that water will remain in the frost-free hydrant and eventually freeze. As the water falls in temperature from 0 to −4 degrees Celsius, then as is well known, the ice expands and may rupture the case of the frost-free hydrant. Although the presence of a rupture will not be noticed while water in the hydrant remains as ice, as temperatures subsequently increase, the ice in the hydrant thaws and escapes as water through the rupture. However, the presence of the sheath 12 which is sealed at its inner end at the joint between the bore 50 and the link pipe 28 and which is open at the plate 14 means that the water can escape and there is no route to flow back into the building. Moreover, when water starts to flow out of the unit between the two plates 14, 51, it will be apparent that a problem exists and that the frost-free unit has to be replaced.

Figure 5:
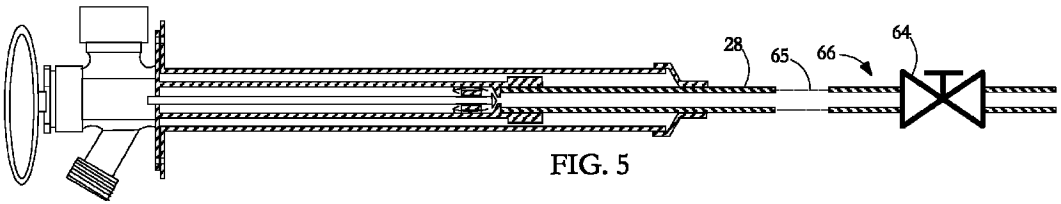
FIG. 5 shows the rupture protection device of FIG. 1 fitted to a frost-free hydrant shorter than the frost-free hydrant of FIG. 2.
Figure 6:
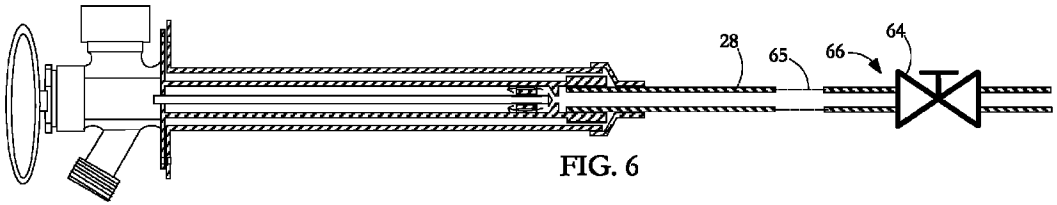
FIG. 6 shows the rupture protection device of FIG. 1 fitted to a frost-free hydrant longer than the frost-free hydrant of FIG. 2.

It will be appreciated that in comparison with known sheath type devices for protecting against water damage from a frost-free hydrant, the design of the present invention is simple and inexpensive to make and install. It does not require accurate manufacturing tolerances, and, as installed, presents a high integrity attachment of the sheath to the frost-free hydrant for which it provides protection. As shown by FIGS. 5 and 6, the same protective sheath device can be used regardless of whether it is to be coupled to a frost-free hydrant at the lower end of the range of lengths (FIG. 5) or at the upper end of the range (FIG. 6). When fitting the protective device, the plumber simply connects, as indicated by 65, the inner end of the link pipe 28 to a valve 64 or other fitment forming a part of the inside supply plumbing 66.

In the preferred embodiments of the invention previously described, joints between the link pipe and respectively the bore 50 in the frost-free hydrant (or the bore 61 if an adaptor is used) and the bore 27 in the end cap section 26 are effected by soldering. It is important that such a fixed joint is used both to constrain any leakwater that enters the sheath in the event of a rupture and to prevent axial creep of the elements of the structure that might cause further water leakage. However, it will be appreciated that the joints can alternatively be effected by brazing, sweating, welding or gluing. It will be appreciated also that although copper is preferred for the material of the described fittings, other materials such as alternative metals and suitable plastics may also be used.

Other variations and modifications of the invention will be apparent to those skilled in the art. The embodiments of the invention described and illustrated are not intended to be limiting. The principles of the invention contemplate many alternatives having advantages and properties evident in the exemplary embodiments.

What is claimed is:

1. A leak protection frost-free hydrant assembly installed at a building, comprising:

a frost-free hydrant having a housing, a first passage through the housing, and a valve having a long stem mounted in the first passage, the valve having a handle at one end of the frost-free hydrant and the first passage having a valve seat near the other end of the frost-free hydrant, the valve rotatable within the first passage by turning the handle to move the valve by screw action longitudinally along the first passage between closed and open positions at the valve seat, the first passage having a first bore behind the valve seat at the other end of the frost-free hydrant, the first bore dimensioned to receive pipe of predetermined exterior diameter in a sealing connection, a unitary protection device comprising a sheath having a second passage extending from one end to the other end, an escutcheon plate at said one end having an opening communicating with the second passage, an end cap at the other end having an integral tube projecting therefrom, the tube having a second bore communicating with the second passage and being dimensioned to receive pipe of the predetermined exterior diameter, the frost-free hydrant having a length which is one of a range of lengths of frost-free hydrants for use with the protection device, the length of the protection device being more than each of the lengths of said range of lengths, a link pipe of said predetermined exterior diameter sealingly connected at one end in the first bore, sealingly connected in the tube, and sealingly connected at its other end to a water supply fitment, the link pipe having a length such that the length of the combined frost-free hydrant and link pipe is greater than the length of the protection device, the protection device and the frost-free hydrant commonly fixed at their outer ends to an outside face of an exterior wall of the building.

2. A method of installing a leak protection, frost-free hydrant assembly at an exterior wall of a building, the assembly comprising:

a frost-free hydrant having a housing, a first passage through the housing, and a valve having a long stem mounted in the first passage, the valve having a handle at one end of the frost-free hydrant and the first passage having a valve seat near the other end of the frost-free hydrant, the valve rotatable within the first passage by turning the handle to move the valve by screw action longitudinally along the first passage between closed and open positions at the valve seat, the first passage having a first bore behind the valve seat at the other end of the frost-free hydrant, the first bore dimensioned to receive pipe of predetermined exterior diameter in a sealing connection, a unitary protection device comprising a sheath having a second passage extending from one end to the other end, an escutcheon plate at said one end having an opening communicating with the second passage, an end cap at the other end having an integral tube projecting therefrom, the tube having a second bore communicating with the second passage and being dimensioned to receive pipe of the predetermined exterior diameter, the frost-free hydrant having a length which is one of a range of lengths of frost-free hydrants for use with the protection device, the length of the protection device being more than each of the lengths of said range of lengths, the method comprising cutting a link pipe from pipe of said predetermined exterior diameter to a length such that the length of the combined frost-free hydrant with the link pipe sealingly connected in the first bore would be greater than the length of the protection device, sealingly connecting the link pipe in the first bore, inserting the protection device into the wall from the outside of the building so that the other end projects beyond the interior of the wall into the interior of the building, at the escutcheon plate, fixing the protection device to the wall, inserting the combined frost-free hydrant and link pipe into the second passage so that part of the link pipe is in the tube and an end part of the link pipe projects beyond the end of the tube, at the exterior of the building, connecting an outer end of the frost-free hydrant housing to the wall, in the interior of the building, sealingly connecting the link pipe in the tube, and sealingly connecting the projecting end part of the link pipe to a water supply fitment in the interior of the building.

* * * * *